US007686484B2

(12) United States Patent
Heiking et al.

(10) Patent No.: US 7,686,484 B2
(45) Date of Patent: Mar. 30, 2010

(54) CEILING-MOUNTED TROFFER-TYPE LIGHT FIXTURE

(75) Inventors: Nathan D. Heiking, Kenosha, WI (US); James W. Hawkins, Lake Bluff, IL (US)

(73) Assignee: Kenall Manufacturing Co., Gurnee, IL (US)

( * ) Notice: Subject to any disclaimer, the term of this patent is extended or adjusted under 35 U.S.C. 154(b) by 0 days.

(21) Appl. No.: 12/023,826

(22) Filed: Jan. 31, 2008

(65) Prior Publication Data

US 2009/0196024 A1 Aug. 6, 2009

(51) Int. Cl.
*F21V 17/00* (2006.01)

(52) U.S. Cl. ..... 362/375; 362/374

(58) Field of Classification Search ..... 362/147, 362/374, 375, 404

See application file for complete search history.

(56) References Cited

U.S. PATENT DOCUMENTS 4,796,001 A * 1/1989 Gostyla ..... 338/20
5,172,976 A * 12/1992 Bogdanovs ..... 362/374
5,997,158 A * 12/1999 Fischer et al. ..... 362/374
6,461,026 B1 * 10/2002 Wang ..... 362/374

* cited by examiner

*Primary Examiner*—Thomas M Sember
(74) *Attorney, Agent, or Firm*—Jansson Shupe & Munger Ltd.

(57) ABSTRACT

A ceiling-mounted troffer-type light fixture for illumination. The fixture comprises a body with a first flange having at least one hook-receiving opening and a second flange with a suspension-member-receiving opening. A cover includes a rectangular frame, at least one catch-arm and at least one suspension member. Frame fasteners along the frame engage the perimeter in a closed position. One-person attaching/closing and removal of the cover for maintenance is facilitated by the cover being supported in an open position, suspended position and fully engaged with the body in a closed position.

6 Claims, 11 Drawing Sheets

LED SYSTEM SCHEMATIC

LED SYSTEM SCHEMATIC

CEILING-MOUNTED TROFFER-TYPE LIGHT FIXTURE

FIELD OF THE INVENTION

This invention is related generally to interior luminaires and more particularly to lighting fixtures which are ceiling-mounted and require periodic servicing.

BACKGROUND OF THE INVENTION

Many different types of lighting fixtures, including ceiling-mounted fixtures for various applications and locations, are known in the art. Such fixtures have been installed for illuminating stores, offices, supermarkets, schools, hospitals, banks, and other interior areas. Appreciating the versatility of such lighting fixtures, including the many engineering designs and configurations, there remains a need for a ceiling-mounted troffer-type light fixture whose cover can be attached, closed, removed and serviced by a single individual. In particular, conventional troffer-type light fixtures and lighting methods are not adapted for installation and maintenance by a single individual.

Many ceiling-mounted fluorescent and LED luminaires require a fixture which is unique, high-performance and also a high-value lighting solution. There is a need for a lighting fixture which can be installed and maintained by a single individual.

Various ceiling-mounted lighting fixtures have been developed to include both apparatus and a method for installing the fixture. An example of such a prior art fixture is disclosed in U.S. Pat. No. 5,997,158 (Fischer et al.). Color-changing devices have also been developed. An example of such a prior art apparatus is seen in U.S. Pat. No. 6,888,322 (Dowling et al.).

Some lighting fixtures of the prior art necessitate several people to work on a single fixture for installation or routine maintenance such as lamp replacement. Specifically, if the door on a lighting fixture is large in size, installing, changing the door, or accessing the lamps often requires two or three maintenance people to remove the door and handle it. This requires a substantial amount of labor and is time-consuming. It would be desirable to have a lighting fixture with a large door which would necessitate only one person to attach, close, or remove the door and service the fixture.

In summary, there are a number of problems and shortcomings in prior ceiling-mounted lighting fixtures.

OBJECTS OF THE INVENTION

It is an object of this invention to provide a ceiling-mounted troffer-type light fixture that overcomes some of the problems and shortcomings associated with the prior art.

Another object is to provide a ceiling-mounted troffer-type light fixture with a large door which can be easily attached, closed and removed by a single individual.

Yet another object is to provide a ceiling-mounted troffer-type light fixture which is low-maintenance and which can be maintained by a single individual.

These and other objects of the invention will be apparent from the following descriptions and from the drawings.

SUMMARY OF THE INVENTION

This invention is a ceiling-mounted troffer-type light fixture. The lighting fixture comprises a body which has a rectangular cover-engaging perimeter and includes along one perimeter edge, a first flange having at least one hook-receiving opening therein and along the opposite perimeter edge, and a second flange having at least one suspension-member-receiving opening. In highly-preferred embodiments, the cover includes (a) a rectangular frame, (b) at least one catch arm with a proximal end rotatably mounted to one edge of the frame and a distal end having a catch-arm hook, each hook removably insertable in one of the hook-receiving opening(s), and (c) at least one suspension member mounted to an opposite edge of the frame, each suspension member insertable in one of the suspension-member-receiving opening(s). The catch arm(s) and suspension member(s) each have sufficient length to suspend the cover away from the body along its entire cover-engaging perimeter when they are hangingly engaged with the flanges, and frame fasteners along the frame engage the perimeter in a fixture-closed position.

In highly preferred embodiments, one-person servicing is facilitated by the cover being supported along one perimeter edge in a fully-open position, supported along two opposite edges in a suspended position, and fully engaged with the body in the fixture-closed position.

In highly preferred embodiments of the inventive fixture, each of the suspension member(s) is a spring clip. Preferably, there are a pair of catch arms spaced along the one edge of the frame, and a pair of spring clips is spaced along the opposite edge of the frame.

The present invention also includes a method for attaching/closing and removing the cover of a ceiling-mounted troffer-type light fixture. In this inventive method, the attaching/closing comprises the steps of: (1) providing a troffer-type light fixture including: (a) a body having a rectangular cover-engaging perimeter and including, along one perimeter edge, a first flange having at least one hook-receiving opening therein and along the opposite perimeter edge, a second flange having at least one suspension-member-receiving opening; (b) a cover including (i) a rectangular frame, (ii) at least one catch arm with a proximal end rotatably engaged to a first edge of the frame and a distal end having a catch-arm hook, each hook removably insertable in a corresponding one of the hook-receiving opening(s), and (iii) at least one suspension member mounted to an opposite edge of the frame, each suspension member insertable in a corresponding one of the suspension-member-receiving opening(s), the catch arm(s) and suspension member(s) each having sufficient length to suspend the cover away from the body along its entire cover-engaging perimeter when they are hangingly engaged with the flanges; and (c) frame fasteners along the frame for engaging the perimeter in a fixture-closed position; (2) manually lifting the fixture cover and causing the catch arm hook(s) to engage with hook receiving opening(s) allowing the cover to hang in an open position; (3) rotating the cover, about the rotatable engagement of the catch arm(s) with the first edge of the frame, until the suspension member(s) engage with the suspension-member-receiving opening(s), thereby enabling the fixture to hang in a suspended position; and (4) closing the cover by pushing the cover towards the body and securing the lens screws so that the cover is held closed against the body.

6. The method of claim 5 wherein the removing comprises the steps of: (1) removing the lens screws which hold the cover against the body and allowing the cover to hang in a suspended position and move to a position in which it is suspended below the body by the catch arm(s) and the suspension member(s); (2) releasing the suspension member(s) from the suspension-member receiving opening(s); (3) rotating the cover about the rotatable engagement of the catch arm(s) with the first edge of the frame until the suspension member(s) disengage with the suspension-member-receiving opening(s), thereby enabling the fixture to hang in an open position; (4) lifting the fixture cover sufficiently to disengage the catch arm hook(s) from the hook-receiving opening(s); and (5) moving the cover to a position away from the body so as to facilitate fixture maintenance.

The term "catch arm" as used herein refers to an arm whose purpose is to catch and hold.

The term "light-diffusing layer" as used herein refers to a layer or lens which scatters light such that images are substantially blurred.

BRIEF DESCRIPTION OF THE DRAWINGS

The drawings illustrate a preferred embodiment including the above-noted characteristics and features of the invention. The invention will be readily understood from the descriptions and drawings. In the drawings.

DETAILED DESCRIPTION OF PREFERRED EMBODIMENTS

In order to illustrate the inventive troffer-type fixture, a medical light fixture embodiment which includes a graphics-displaying light box middle section and two examination light side sections is used herein.

Figure 1:
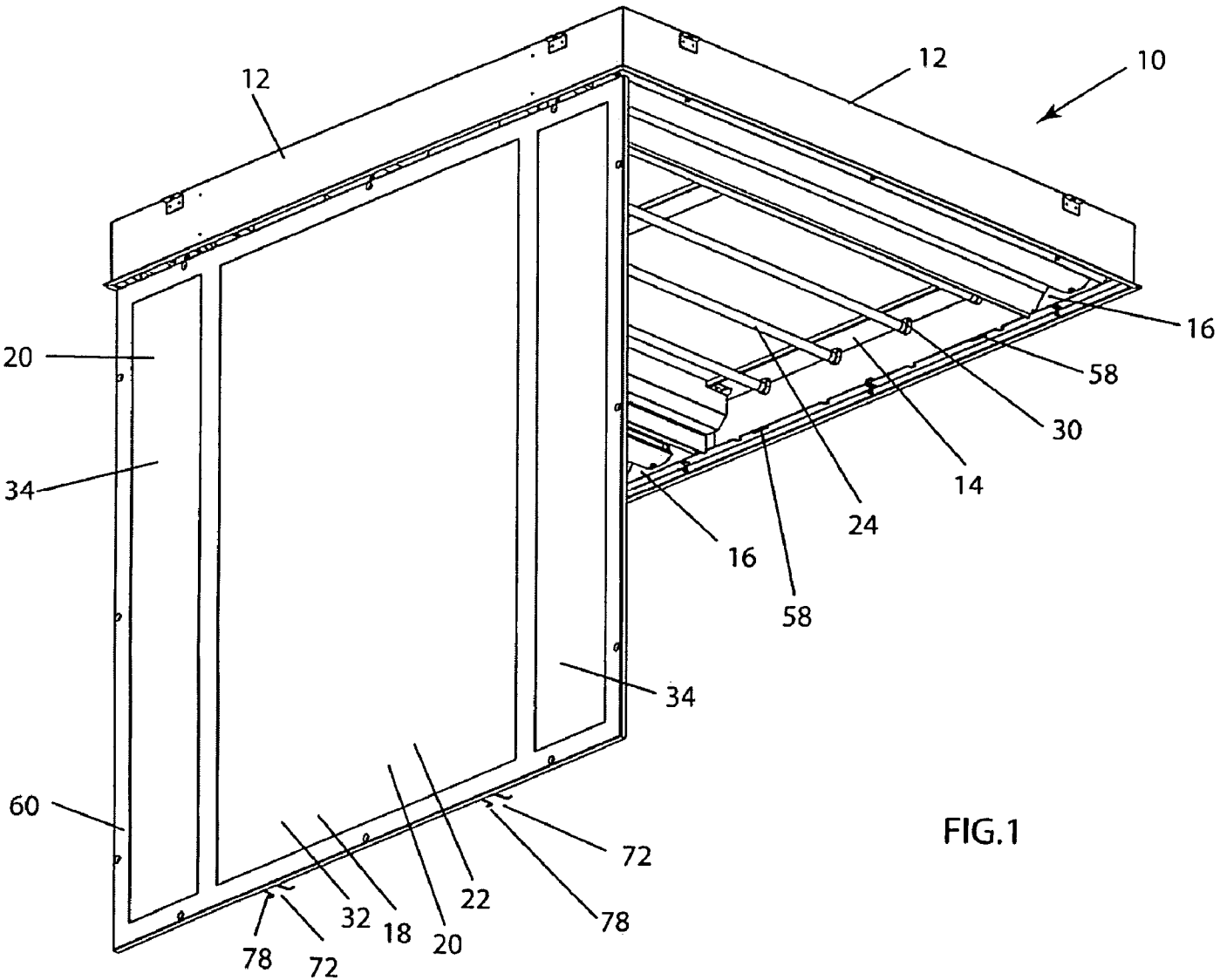
FIG. 1 is a perspective view of the lighting fixture with the cover in the open position.
Figure 2:
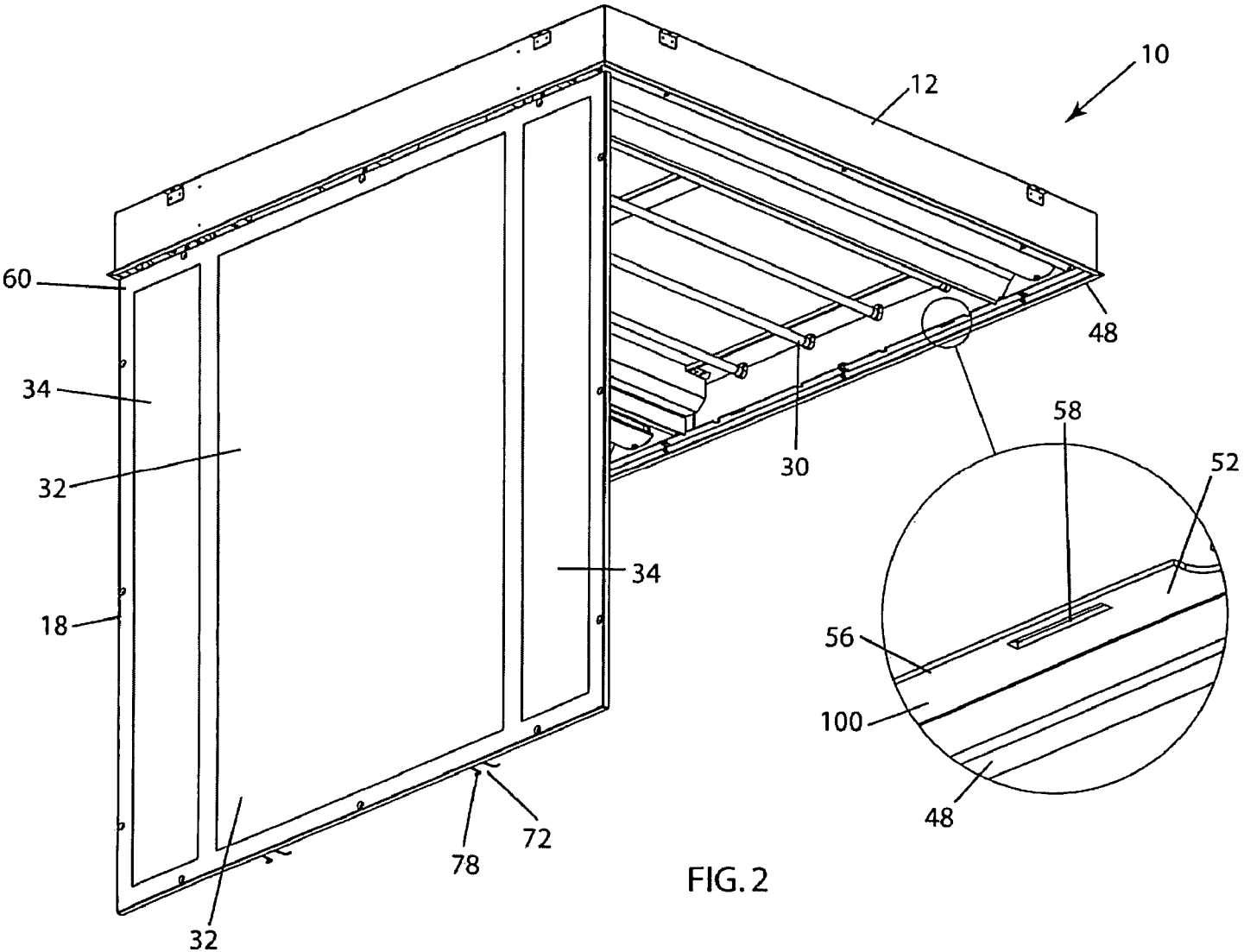
FIG. 2 is a perspective view of the lighting fixture of FIG. 1, with the cover in the open position and illustrating the suspension-member-receiving opening.
Figure 3:
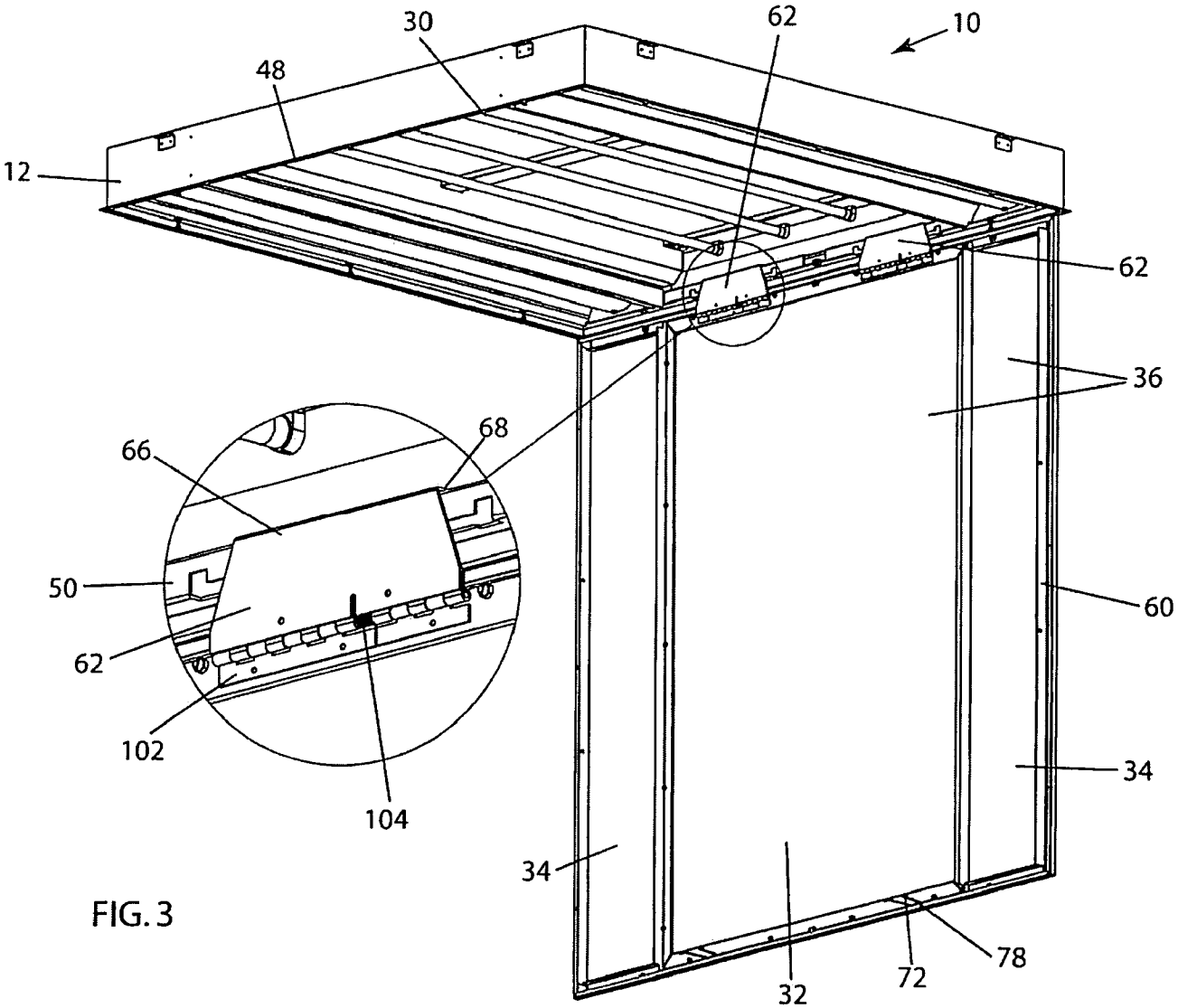
FIG. 3 is a perspective view of the lighting fixture of FIG. 1, with the cover in the open position and illustrating a catch arm.

FIGS. 1-5 illustrate lighting fixture 10 having at least one exam-light 26 and a graphics image (not illustrated). As shown in FIG. 1, lighting fixture 10 has body 12 which has middle region 14 and two side regions 16 along opposite sides of middle region 14. As illustrated in FIGS. 1-3, lighting fixture 10 also has cover 18 moveably attached to body 12 which includes lens 20 over at least middle region 14. Lighting fixture 10 also includes a graphics image which is associated with middle region 14 and which is substantially parallel to lens 20. At least one graphics-light source 24 is within middle region 14 and is configured for illuminated display of the graphics image as shown in FIGS. 1-3. FIGS. 1-3 also illustrate lens 20 upon which graphics image 22 is illuminated. FIGS. 1-3 do not illustrate a particular graphics image on lens 20, but it is readily understood that the graphics image is viewed on middle lens 32.

Figure 5:
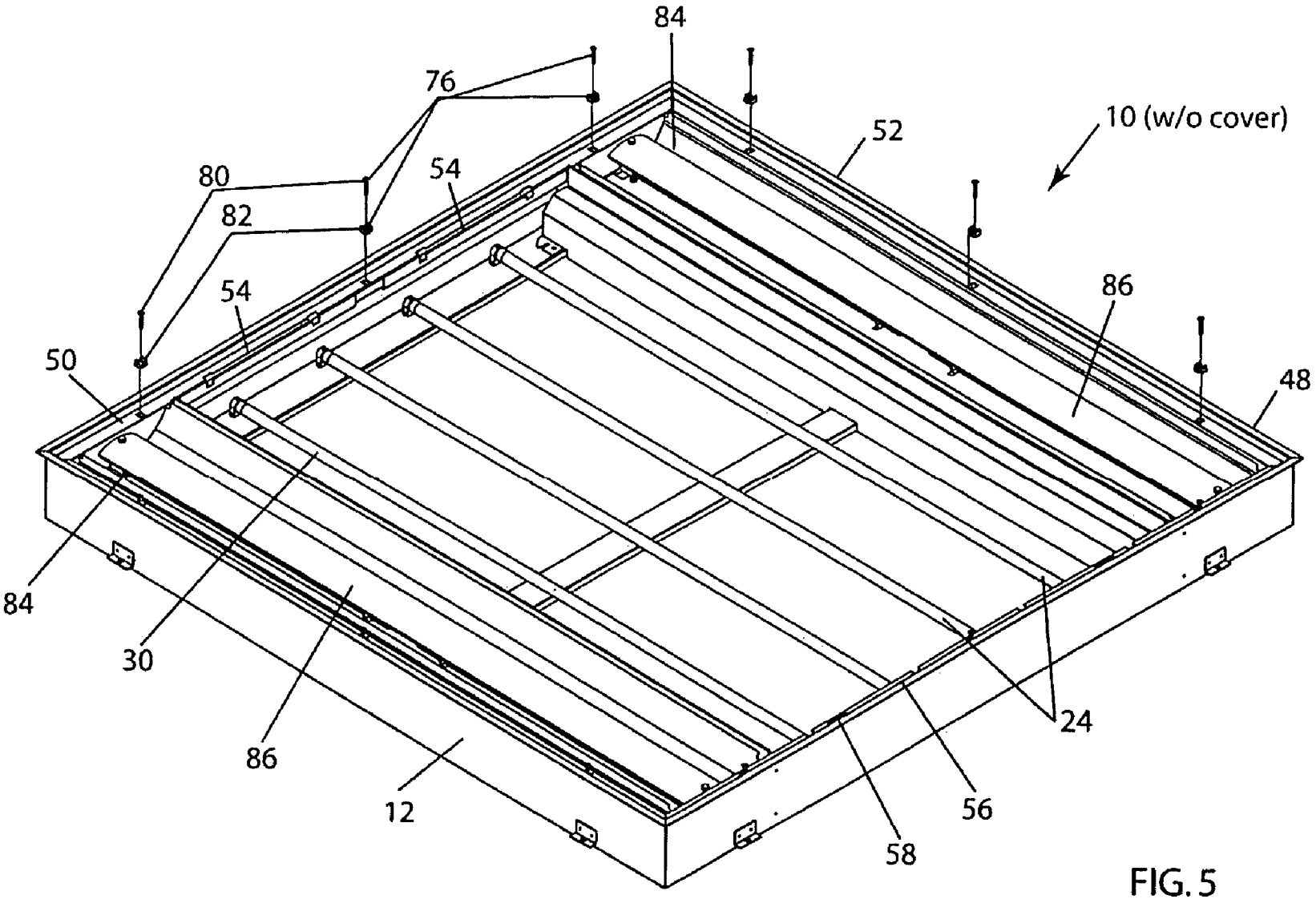
FIG. 5 is a perspective view of the lighting fixture of FIG. 1 with the cover removed.
Figure 6:
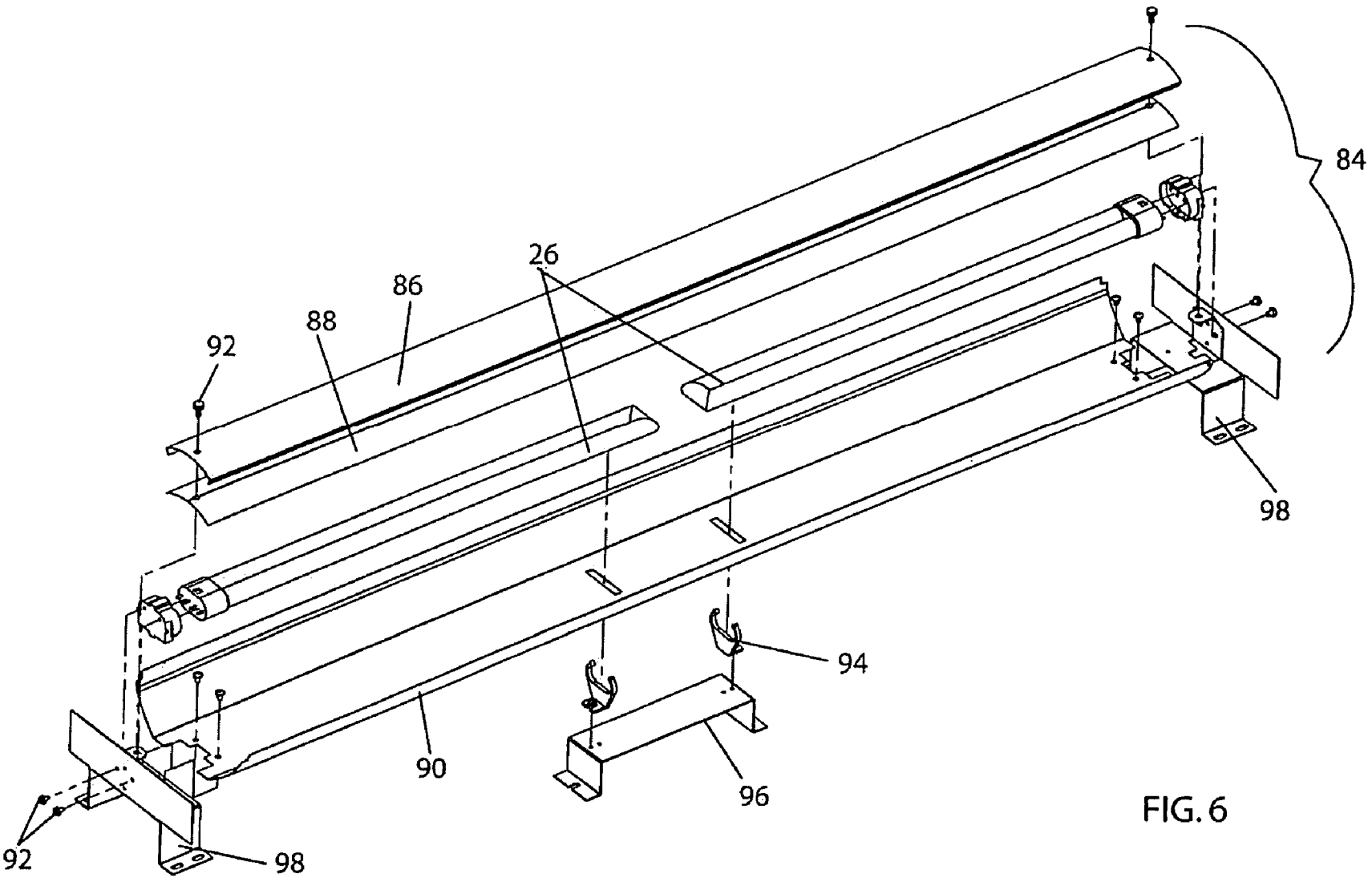
FIG. 6 an exploded view of the exam-lamping assembly including the exam-light source of the lighting fixture of FIG. 1.

Lighting fixture 10 includes at least one exam-light source 26 within each of two side regions 16 and a fixture controller 28 which is able to separately control graphics-light source 24 and exam-light source 26 as illustrated in FIGS. 1-3. This allows for the graphics image to be displayed for a viewer along middle region 14 and also allows illumination for examination which is provided from side regions 16. Exam-light source 26 is part of an exam-lamping assembly 84 as seen in FIGS. 5-6. As illustrated in FIG. 6, exam-lamping assembly 84 includes various screws 92 which keep exam-lamping assembly 84 in the assembled position. As seen in FIG. 6, exam-lamping assembly 84 further includes lamp support clips 94 and bracket 96 which hold aluminum diffuser 86, acrylic diffuser 88, parabolic diffuser 90 and lamps 26 in the assembled position. Lamps 26 are further held in place by two lamp socket brackets 98 which are placed on each side of lamps 26 as seen in FIG. 6. Lighting fixture 10 includes exam-light ballast 108 and graphics-light ballast 110 (including a ballast cover 114) as illustrated in FIG. 7.

Figure 4:
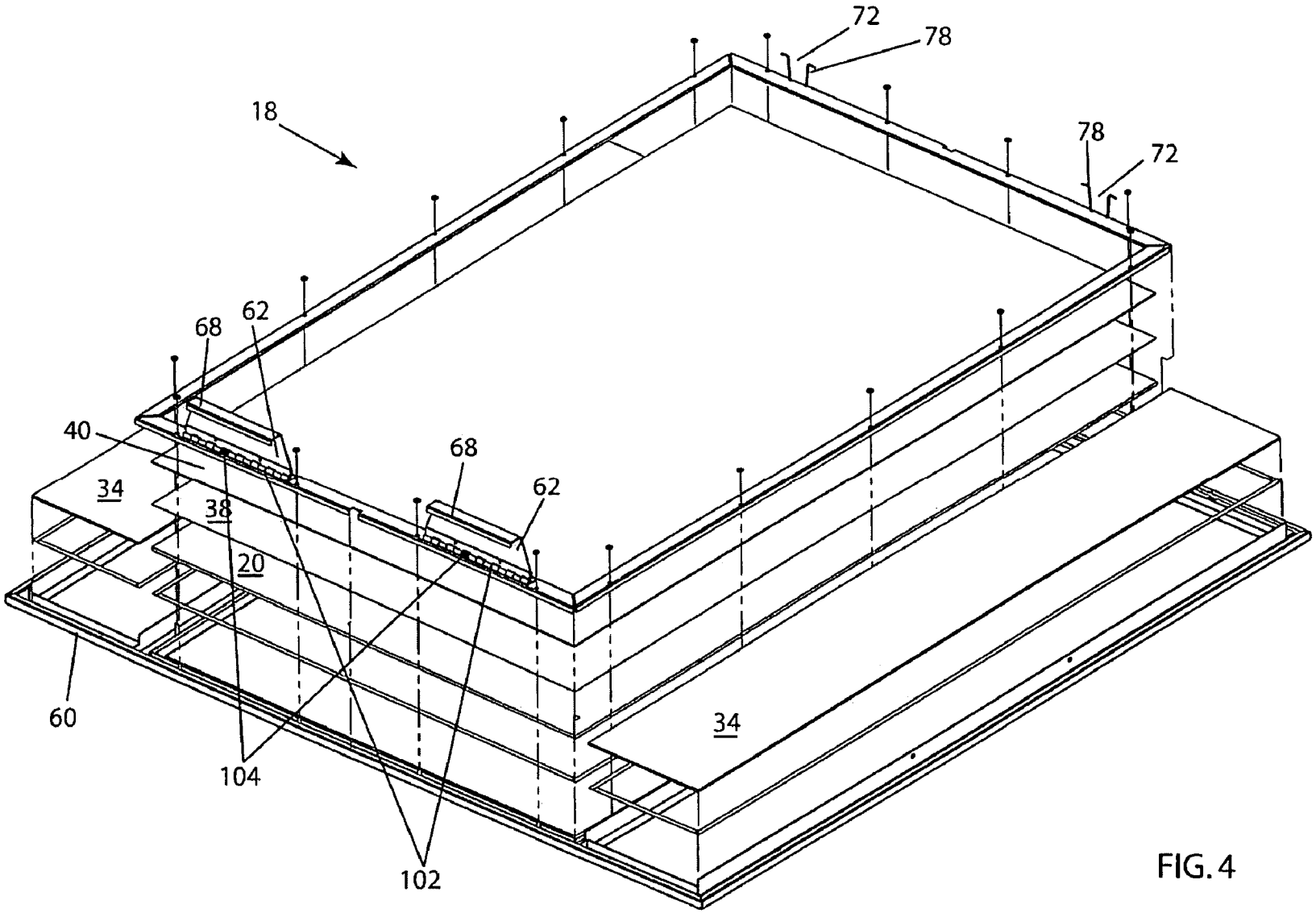
FIG. 4 is an exploded perspective view of the cover of the lighting fixture of FIG. 1.

As illustrated in FIGS. 1-2 and 4, cover 18 is a single structure over middle region 14 and both side regions 16. FIGS. 1-2 illustrate cover 18 in an open position to allow access to lamps 30. FIG. 7 illustrates that lens 20 is sealingly engaged with cover 18 and cover 18 is sealingly engaged with body 12.

Figure 7:
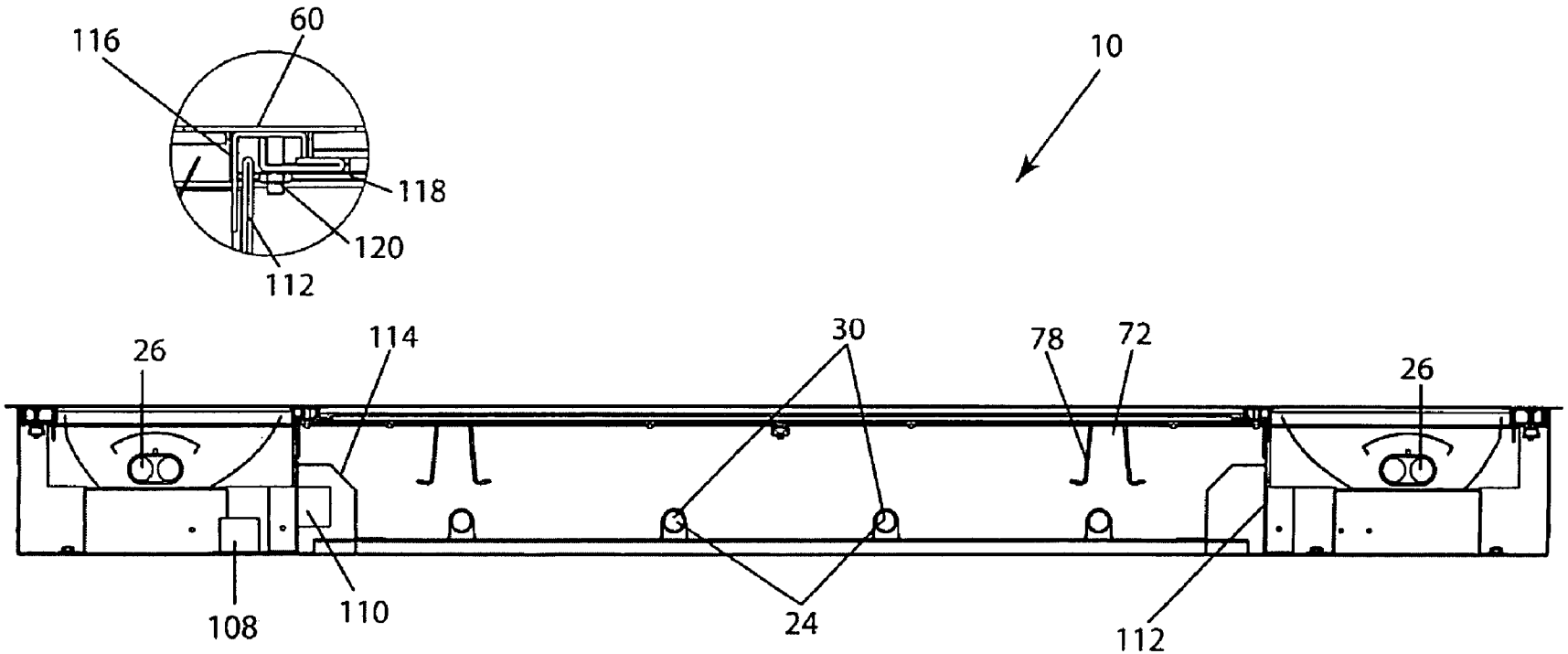
FIG. 7 is a side perspective view of the lighting fixture of FIG. 1 illustrating the light blocking bracket.

FIG. 7 also illustrates lens 20 includes middle lens 32 and further includes two side lenses 34 each over a respective one of side regions 16 and that each of side lenses 34 is sealingly engaged with cover 18. Middle region 14 and side regions 16 are separated by divider 112 as illustrated in FIG. 7. Lighting fixture 10 is given stability through the interaction of light blocking bracket 116 with middle lens retainer bracket 118 as seen in the exploded view of FIG. 7. The exploded view of FIG. 7 also illustrates retainer bracket fasteners 120 which secure middle lens retainer bracket 118 to light blocking bracket 116 and ultimately to frame 60.

FIG. 4 is an exploded view of lighting fixture 10 which illustrates that lens 20 has inside surface 36 and the graphics image is on a separate light-transmissive graphics layer 38 removably placed on inside surface 36. Light fixture 10 further includes a separate inner layer 40 as illustrated in FIG. 4. Graphics layer 38 is sandwiched between lens 20 and inner layer 40. Inner layer 40 as illustrated in FIG. 4 is a light-diffusing layer.

Figure 8:
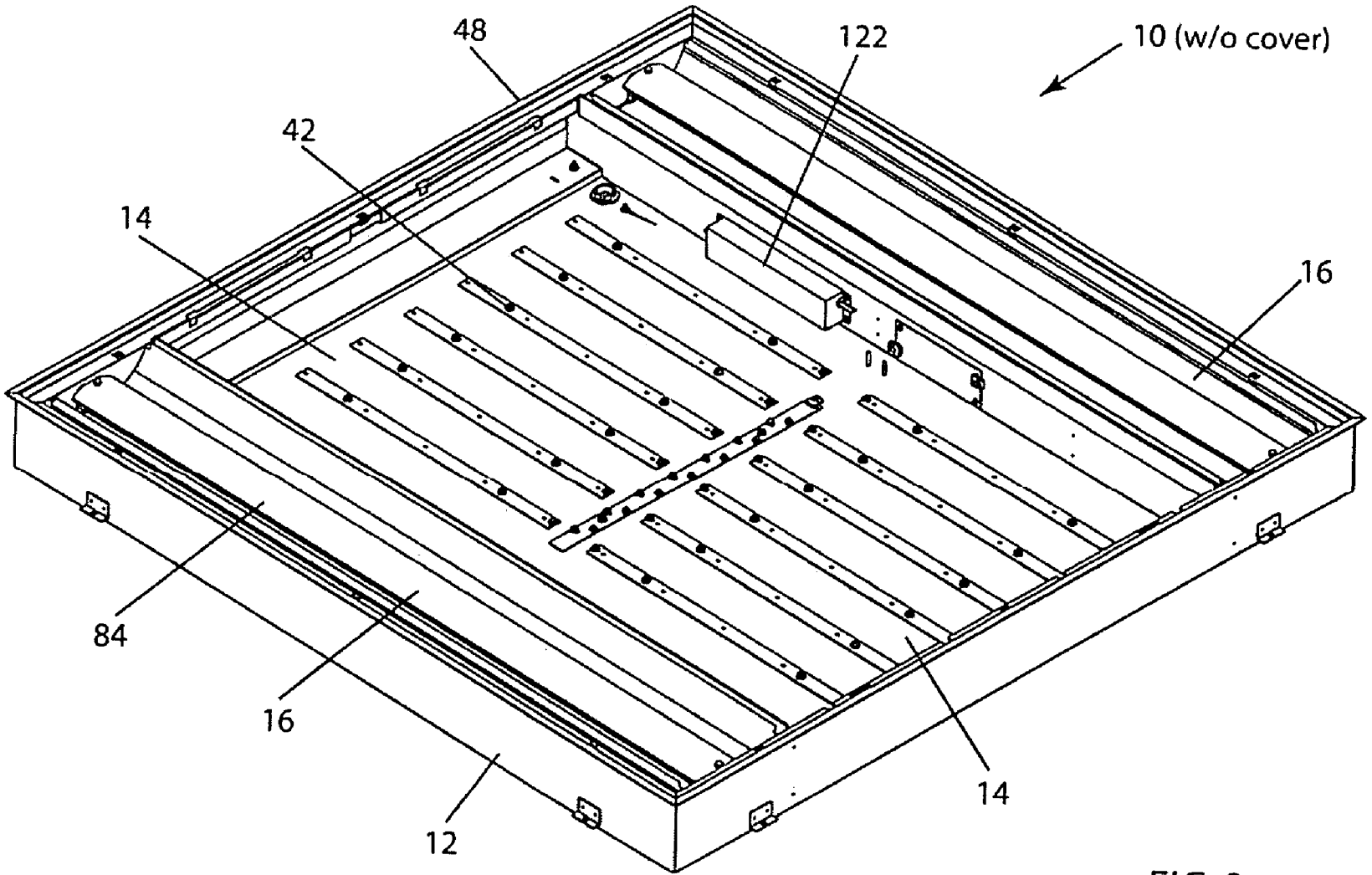
FIG. 8 is a perspective view of an alternate embodiment of the lighting fixture (with the cover removed) of FIG. 1, in which the graphics light source is an array of white LEDs.

As shown in FIGS. 1-3, graphics-light source 24 is a plurality of fluorescent lamps 30. In an alternate embodiment, as shown in FIG. 8, graphics-light source 24 is an array of white light emitting diodes (LEDs) 42. FIG. 8 illustrates LED driver 122 with constant voltage output and line-voltage input.

Figure 9:
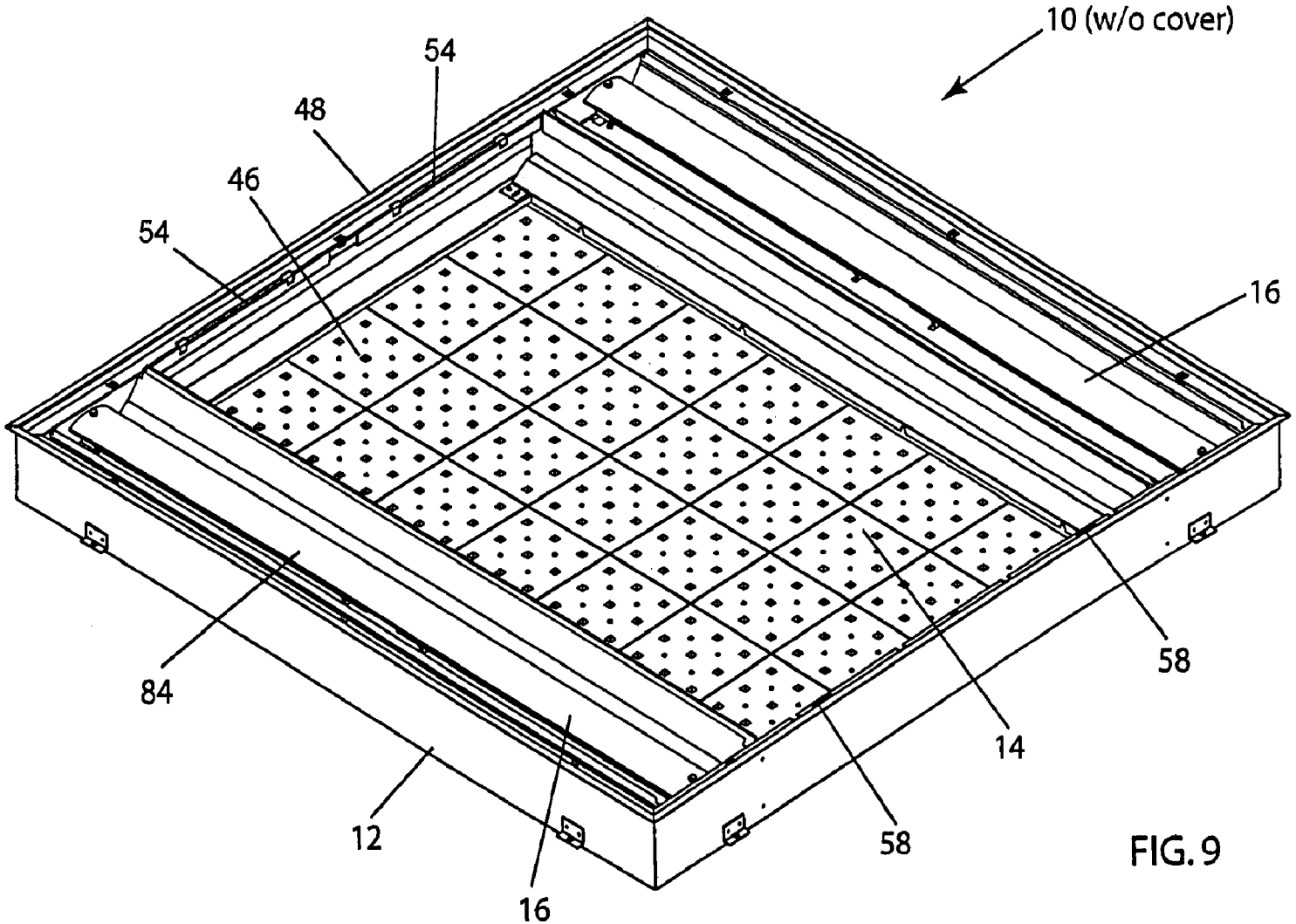
FIG. 9 is a perspective view of an alternate embodiment of the lighting fixture (with the cover removed) of FIG. 1, in which the graphics light source is an array of colored LEDs.
Figure 11:
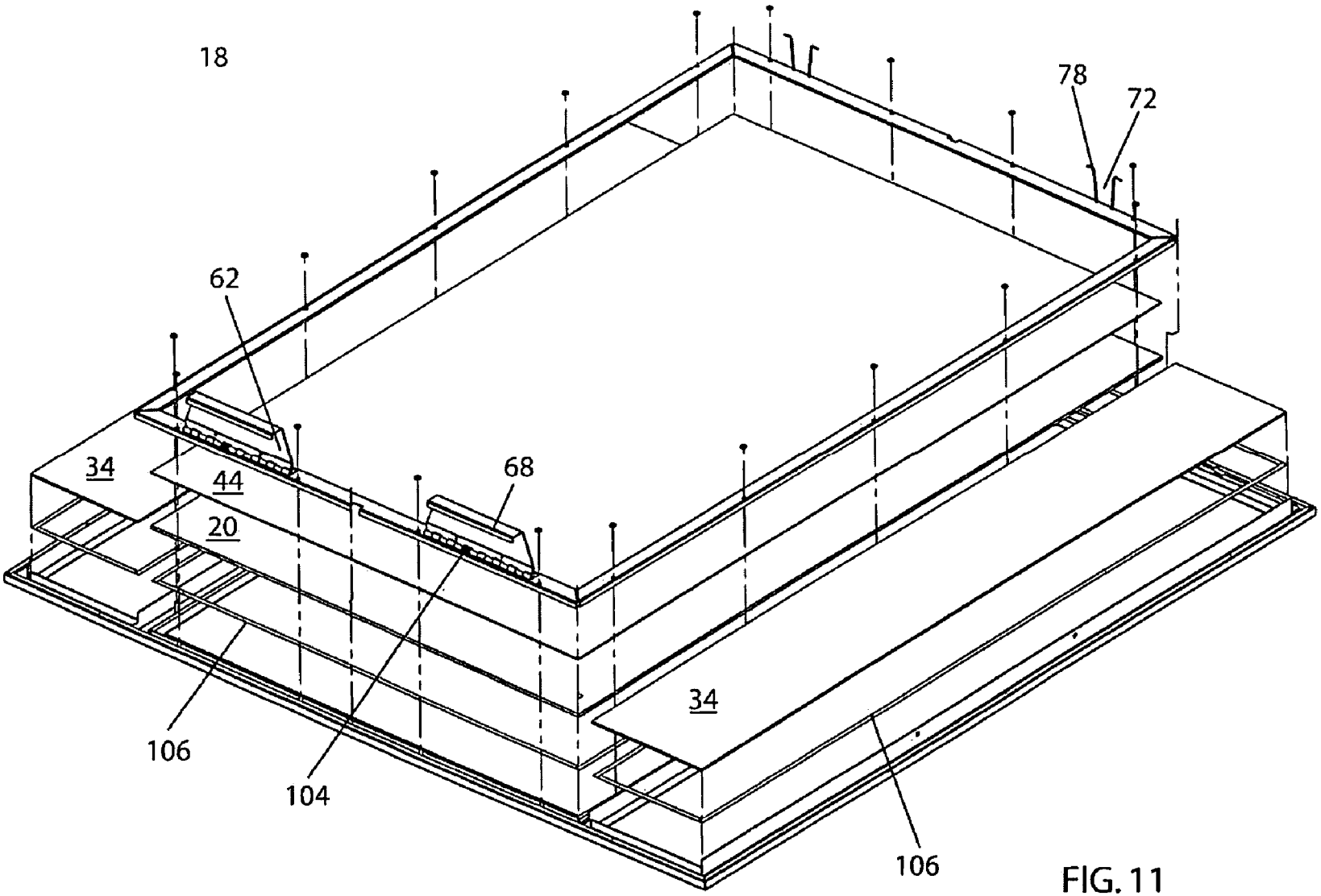
FIG. 11 is an exploded perspective view of the cover of the lighting fixture of FIG. 9.

Another alternate embodiment, as shown in FIGS. 9 and 11, includes a semi-transparent screen layer 44 wherein graphics-light source 24 is an array of color-controllable LEDs 46, and the graphics image is formed by LED illumination of screen layer 44. In another embodiment, lens 20 and screen layer 44 are a single layer (not shown). Screen layer 44 and lens 20 may also be separate layers as illustrated in FIG. 11.

Figure 10B:
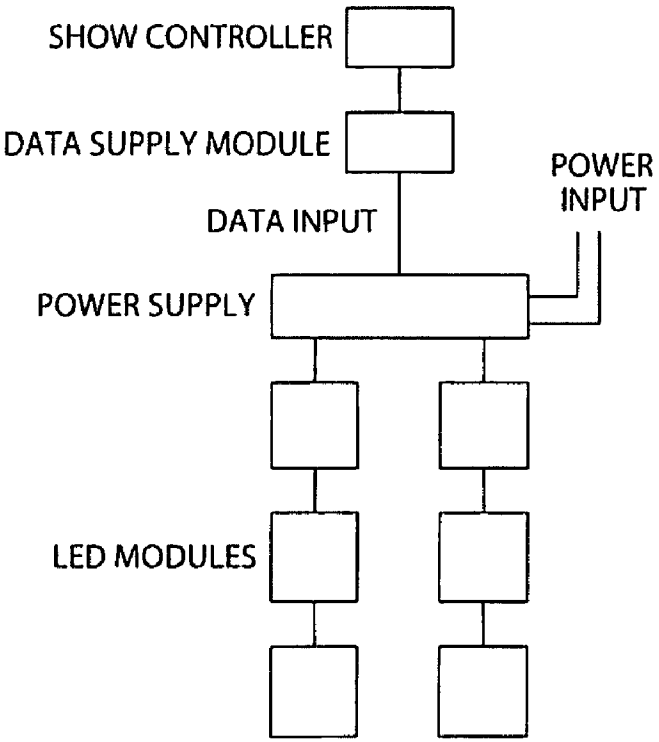
FIG. 10B is an system schematic of the lighting fixture of FIG. 9.
Figure 10A:
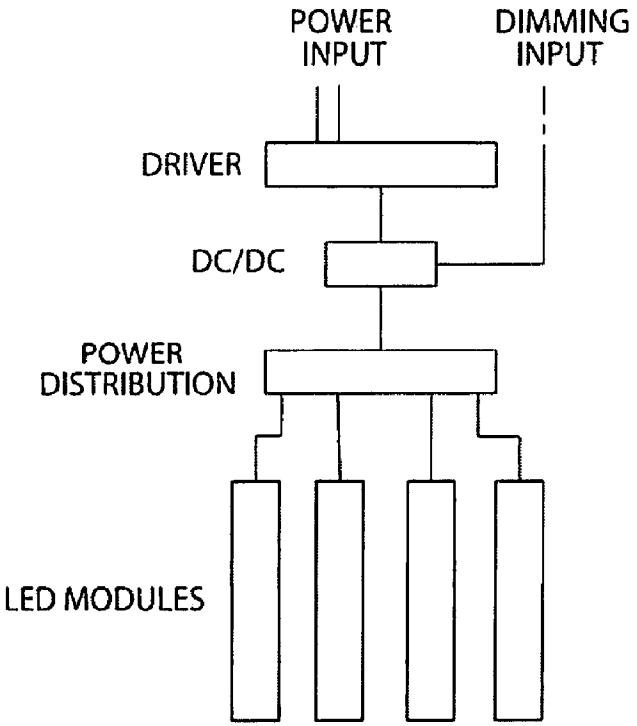
FIG. 10A is an system schematic of the lighting fixture of FIG. 8.

The light fixture 10 preferably includes a fixture controller 28 which is programmed to temporally control the LEDs of the array as seen in FIGS. 8-9. Fixture controller 28 can be one switch or a series of switches. The programmed fixture controller can be programmed to provide a variety of possible time histories of illumination by varying source selection, color, and time histories of the LEDs. FIG. 10A is an LED system schematic of the lighting fixture of FIG. 8. FIG. 10B is an LED system schematic of the lighting fixture of FIG. 9.

As illustrated in FIGS. 1-3 and 5, body 12 of lighting fixture 10 has a rectangular cover-engaging perimeter 48 and includes first flange 50 along one perimeter edge 52 which has at least one hook-receiving opening 54 therein (hook-receiving opening is specifically shown on FIG. 5). Body 12 also includes second flange 56 along the opposite perimeter edge having at least one suspension-member-receiving opening 58 as seen in FIGS. 1-3 and 5.

FIGS. 1-3 illustrate cover 18 which includes rectangular frame 60 which has at least one catch arm 62 with proximal end 64 rotatably mounted to one edge of frame 60 and distal end 66 having catch-arm hook 68. As seen in FIG. 3, each hook 68 is removably insertable in one of the hook-receiving opening(s) 54. Cover 18 also includes cover hinge 102 and torsion spring 104 which assist in moving cover 18 from open to closed position. FIG. 3 also includes an enhanced view of catch arm 62 and more clearly illustrates several elements of fixture 10.

As illustrated in FIG. 2, at least one suspension member 72 is mounted to an edge opposite catch arm 62 on frame 60. Each suspension member 72 is insertable in one of the suspension-member-receiving opening(s) 58 as seen in FIG. 2. Catch arm(s) 62 and suspension member(s) 72 each have sufficient length to suspend cover 18 away from body 12 along its entire cover-engaging perimeter 48 when they are hangingly engaged with flanges 50, 56, and frame fasteners 76, along frame engaging perimeter 60, are in a fixture-closed position as seen in FIGS. 2 and 7. FIG. 2 also includes an enhanced view of suspension-member receiving opening 58 which is situated on gasket seal surface 100. FIG. 2 more clearly illustrates several elements of fixture 10. As illustrated in FIG. 5, frame fasteners 76 include lens screw 80 and cage nut 82.

FIG. 7 illustrates lighting fixture 10 in a closed position. Each of the suspension member(s) 72 are preferably spring clip(s) 78. Preferred embodiments as seen in FIG. 3 include a pair of catch arms 62 spaced along one edge of frame 60 and a pair of spring clips 78 spaced along opposite edge of frame 60.

One-person servicing is facilitated by cover 18 being supported along one perimeter edge 52 in a fully-open position (as seen in FIGS. 1-3), supported along two opposite edges in a suspended position, and fully engaged with the body in the fixture-closed position (as seen in FIG. 7).

When lighting fixture 10 is in use, the graphics image is projected from lighting fixture 10 and can be periodically changed to a new graphics image. To change the graphics image, one must first install a plurality of ceiling light fixtures 10 in patient rooms (or any room where light fixture 10 is desired). Cover 18 must then be opened, graphics layer 38 is removed from each of the opened fixtures 10, removed graphics layer 38 is replaced with a different graphics layer 38, and cover 18 is closed. The step of removing graphics layer 38 includes removing each of the graphics layers 38 from its corresponding cover 18. The step of removing graphics layers 38 also includes fully detaching each of the opened covers 18 from its corresponding fixture body 12.

Body 12 may be constructed out of 0.050-0.063 inch-thick, formed sheet aluminum and associated hardware and electrical components. Body 12 is preferably TIG-welded to ensure a sealed fixture 10. Internal brackets can be spot welded or fastened to body 12 by pressure-fit, sealed studs.

Cover 18 consists of a formed sheet of aluminum frame that is TIG-welded at its corner seams. Cover 18 also contains stiffening members spot-welded onto frame 60 to prevent excessive flexibility. Side lenses 34 are preferably made from clear acrylic sheet with a thickness of 0.125 inches. Middle lens 32 is preferably made from clear acrylic sheet with a thickness of 0.177 inches. Lenses 32 and 34 are preferably sealed and secured to cover 18 by adhesive tape 106 as illustrated in FIG. 4. Double-sided 3M VHB adhesive tape is preferably used.

A wide variety of materials are available for the various parts discussed and illustrated herein. While the principles of this invention have been described in connection with specific embodiments, it should be understood clearly that these descriptions are made only by way of example and are not intended to limit the scope of the invention.

The invention claimed is:

1. An indoor ceiling-mounted troffer-type light fixture comprising:

an indoor ceiling-mounted body having a rectangular cover-engaging perimeter and including (a) along one perimeter edge a first flange having at least one hook-receiving opening therein and (b) along the opposite perimeter edge a second flange having at least one suspension-member-receiving opening;

a cover including (a) a rectangular frame having edges, (b) at least one catch arm with a proximal end rotatably engaged to a first edge of the frame and a distal end having a catch-aim hook, each hook removably inserted in a corresponding one of the hook-receiving opening(s), and (c) at least one suspension member mounted to an opposite edge of the frame, each suspension member removably inserted in a corresponding one of the suspension-member-receiving opening(s), the catch arm(s) and suspension member(s) each having sufficient length to suspend the cover away from the body along its entire cover-engaging perimeter when they are hangingly engaged with the flanges, each hook and suspension member being fully disengageable from the body to allow the cover to be lifted from the body; and frame fasteners along all edges of the frame for engaging the perimeter in a fixture-closed position and for sealing the fixture from contaminants;

whereby one-person servicing is facilitated by the cover being selectively (a) completely removed from the body, (b) supported only along one perimeter edge in a fully-open position, (c) supported along two opposite edges in a below-the-body suspended position, and (d) fully engaged with the body in the fixture-closed position.

2. The indoor ceiling-mounted troffer-type light fixture of claim 1 wherein each of the suspension member(s) is a spring clip.

3. The indoor ceiling-mounted troffer-type light fixture of claim 2 wherein there are a pair of catch arms spaced along the one edge of the frame and a pair of spring clips spaced along the opposite edge of the frame.

4. The indoor ceiling-mounted troffer-type light fixture of claim 3 wherein the suspension members are spring clips.

5. A method for attaching/closing and removing the cover of an indoor ceiling-mounted troffer-type light fixture. the attaching/closing comprising the steps of:

providing a troffer-type light fixture including:

an indoor ceiling-mounted body having a rectangular cover-engaging perimeter and including (a) along one perimeter edge a first flange having at least one hook-receiving opening therein and (b) along the opposite perimeter edge a second flange having at least one suspension-member-receiving opening;

a cover including (a) a rectangular frame having edges, (b) at least one catch arm with a proximal end rotatably engaged to a first edge of the frame and a distal end having a catch-arm hook, each hook removably inserted in a corresponding one of the hook-receiving opening(s), and (c) at least one suspension member mounted to an opposite edge of the frame, each suspension member removably inserted in a corresponding one of the suspension-member-receiving opening(s). the catch arm(s) and suspension member(s) each having sufficient length to suspend the cover away from the body along its entire cover-engaging perimeter when they are hangingly engaged with the flanges, each hook and suspension member being fully disengageable from the body to allow the cover to be lifted from the body; and frame fasteners along all edges of the frame for engaging the perimeter in a fixture-closed position and for sealing the fixture from contaminants;

manually lifting the fixture cover and causing the catch arm hook(s) to engage with hook receiving opening(s) allowing the cover to hang in an open position;

rotating the cover, about the rotatable engagement of the catch arm(s) with the first edge of the frame. until the suspension member(s) engage with the suspension-member-receiving opening(s), thereby enabling the fixture to hang in a suspended position; and closing the cover by pushing the cover towards the body and securing lens screws so that the cover is held closed against the body.

6. The method of claim 5 wherein the removing comprises the steps of:

removing the lens screws which hold the cover against the body and allowing the cover to hang in a suspended position and move to a position in which it is suspended below the body by the catch arm(s) and the suspension member(s);

releasing the suspension member(s) from the suspension-member receiving opening(s);

rotating the cover, about the rotatable engagement of the catch arm(s) with the first edge of the frame, until the suspension member(s) disengage with the suspension-member-receiving opening(s), thereby enabling the fixture to hang in an open position;

lifting the fixture cover sufficiently to disengage the catch arm hook(s) from the hook-receiving opening(s); and moving the cover to a position away from the body so as to facilitate fixture maintenance.

* * * * *

UNITED STATES PATENT AND TRADEMARK OFFICE

CERTIFICATE OF CORRECTION

PATENT NO. : 7,686,484 B2
APPLICATION NO. : 12/023826
DATED : March 30, 2010
INVENTOR(S) : Nathan D. Heiking et al.

It is certified that error appears in the above-identified patent and that said Letters Patent is hereby corrected as shown below:

Column 2, lines 60-61, delete "6. The method of claim 5 wherein the removing comprises the steps of:" and insert --The removing step comprises--.

Signed and Sealed this

Twenty-fifth Day of May, 2010

David J. Kappos

David J. Kappos
*Director of the United States Patent and Trademark Office*